United States Patent [19]

Talley

[11] 4,244,101

[45] Jan. 13, 1981

[54] APPARATUS FOR ATTACHING TERMINALS TO ELECTRIC CONDUCTORS

[75] Inventor: Lloyd A. Talley, Valinda, Calif.

[73] Assignee: Eubanks Engineering Co., Monrovia, Calif.

[21] Appl. No.: 14,934

[22] Filed: Feb. 26, 1979

[51] Int. Cl.[3] ..... H01R 43/04

[52] U.S. Cl. ..... 29/753; 29/759

[58] Field of Search ..... 29/753, 759, 564.1, 29/564.3, 564.4, 564.6

[56] References Cited

U.S. PATENT DOCUMENTS

| | | | |
|---|---|---|---|
| 3,668,764 | 6/1972 | Randar | 29/753 X |
| 3,769,681 | 11/1973 | Eubanks | 29/759 X |
| 3,869,781 | 3/1975 | Eubanks et al. | 29/753 X |

*Primary Examiner*—Carl E. Hall

*Attorney, Agent, or Firm*—Robert M. McManigal

[57] ABSTRACT

Apparatus for successively attaching terminals to the stripped ends of electric conductors which are delivered from a wire cutting and insulation stripping apparatus to a conductor supply zone in which the conductors are successively picked up by gripping jaws of finger assemblies carried by a conveyor chain and transported to a terminal attaching zone in which the conductor is axially moved to position a stripped end in a receiving portion of a terminal that has been delivered to an associated terminal attaching device and in which appropriate dies are operative to secure the terminal to the conductor end.

17 Claims, 17 Drawing Figures

FIG. 8.
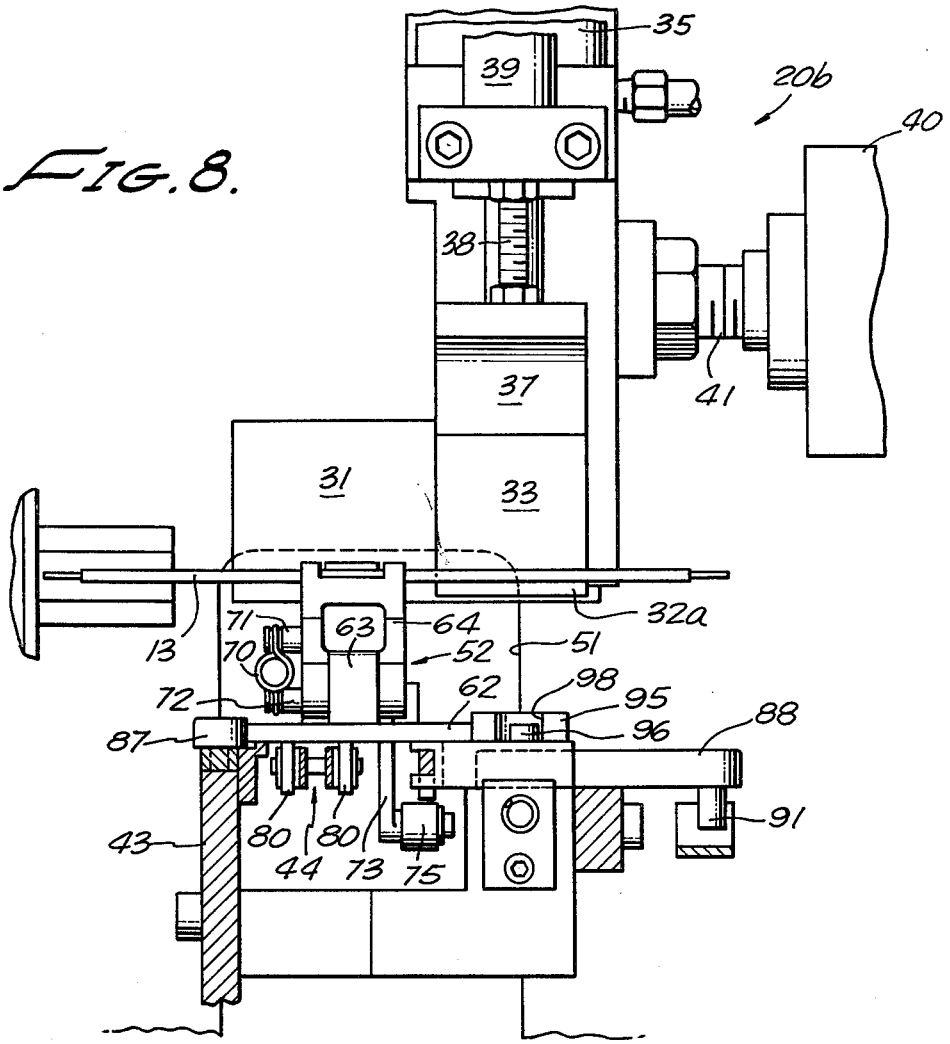
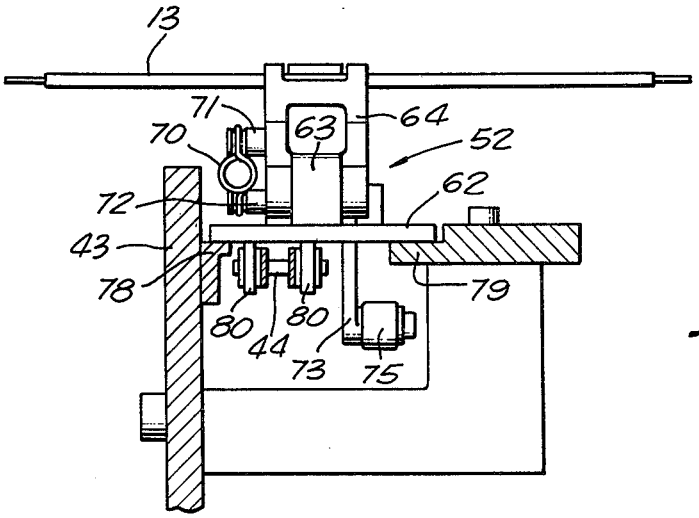
FIG. 9.

APPARATUS FOR ATTACHING TERMINALS TO ELECTRIC CONDUCTORS

BACKGROUND OF THE INVENTION

The present invention relates generally to improvements in the art of producing electric conductors with an attached end terminal.

It has been known heretofore from U.S. Pat. Nos. 3,769,681 and 3,869,781, which are incorporated in this application by reference, to provide a conveyor arrangement which is attached to and cooperatively associated with a conventional type of high speed wire cutter and insulation stripping apparatus of the type shown and described in U.S. Pat. No. 2,934,982, issued May 3, 1960.

In general, the present invention in its broad concept is similar to that disclosed in the above patents and has the same objectives. The present invention, however, incorporates a redesign of a number of the component parts and assemblies, such that the overall operation of the apparatus is greatly improved and its efficiency increased.

A number of the improved features include:

1. The stripped conductor in the supply zone is more positively picked up by the gripping jaws of an improved finger assembly. The conductor gripping fingers, while in an opened position, are moved under the fixedly held conductor, and upon release will positively grip the conductor before it is released. No adjustments are necessary in order to accommodate different sized conductors.

2. Unique means are provided for stopping the conveyor and locking it in such manner that the conductor gripping assembllies will be accurately and properly positioned in both the supply zone and the terminal attaching zone.

3. The provision of an improved wire inserter device in the terminal attaching zone for axially moving the stripped conductor in a manner to position one of its stripped ends in the wire receiving portion of the terminal, and which is selectively adjustable for use with terminals of the type having either open or closed barrel wire receiving portions.

SUMMARY OF THE INVENTION

The present invention is more particularly concerned with the production of improved apparatus for attaching terminals at the ends of electrical conductors.

In its broad concept, it is an object of the present invention to provide an improved and more reliable apparatus for the high speed production of electric conductors of predetermined lengths and for the attachement of a terminal to at least one end of the conductor.

A further object is concerned with the provision in such apparatus of an improved conductor gripping finger assembly which is mounted on a carrier plate having guided relation with a guide track as it is moved along the upper run of a conveyor chain, and in which unique means are operable to interconnect the gripping fingers of each assembly for concerted coordinated movement between gripping and non-gripping positions.

A further object resides in the provision of means for accurately positioning the finger gripping assemblies at the conductor supply zone and terminal attaching zone, and simultaneously locking the conveyor against longitudinal movement during the conductor pick-up in the supply zone and the affixing of a terminal to the conductor end in the terminal attaching zone.

Another object is to provide an improved conductor inserter means in the terminal attaching zone for gripping a conductor, while being held by the gripping fingers, and moving it in an endwise direction to position an end thereof in a proper location for the attachment of the terminal.

It is also an object to provide inserter means according to the previous object, which is selectively adjustable for use respectively for the attachment of terminals having either a closed or open barrel conductor end receiving portion.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 8 is an enlarged fragmentary view similar to FIG. 7 except showing additional details of the structure, particularly the gripping finger assembly;

FIG. 9 is an enlarged fragmentary transverse sectional view, taken substantially on line 9—9 of FIG. 2;

DESCRIPTION OF THE PREFERRED EMBODIMENT

Figure 17:
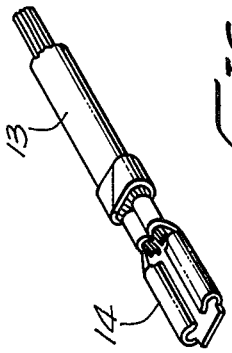
FIG. 17 is a perspective view showing a terminal attached to an electric conductor by means of the apparatus of the present invention.

As shown more specifically in the drawings, the apparatus of the present invention utilizes wire cutter and insulation stripping apparatus, as generally indicated at 10, in association with a conveyor mechanism, as generally indicated at 11, and terminal attaching mechanism, as generally indicated at 12, these components being operatively interconnected, coordinated and synchronized to produce an electric conductor 13 of predetermined length having a terminal 14 attached to one end, as shown in FIG. 17.

Figure 1:
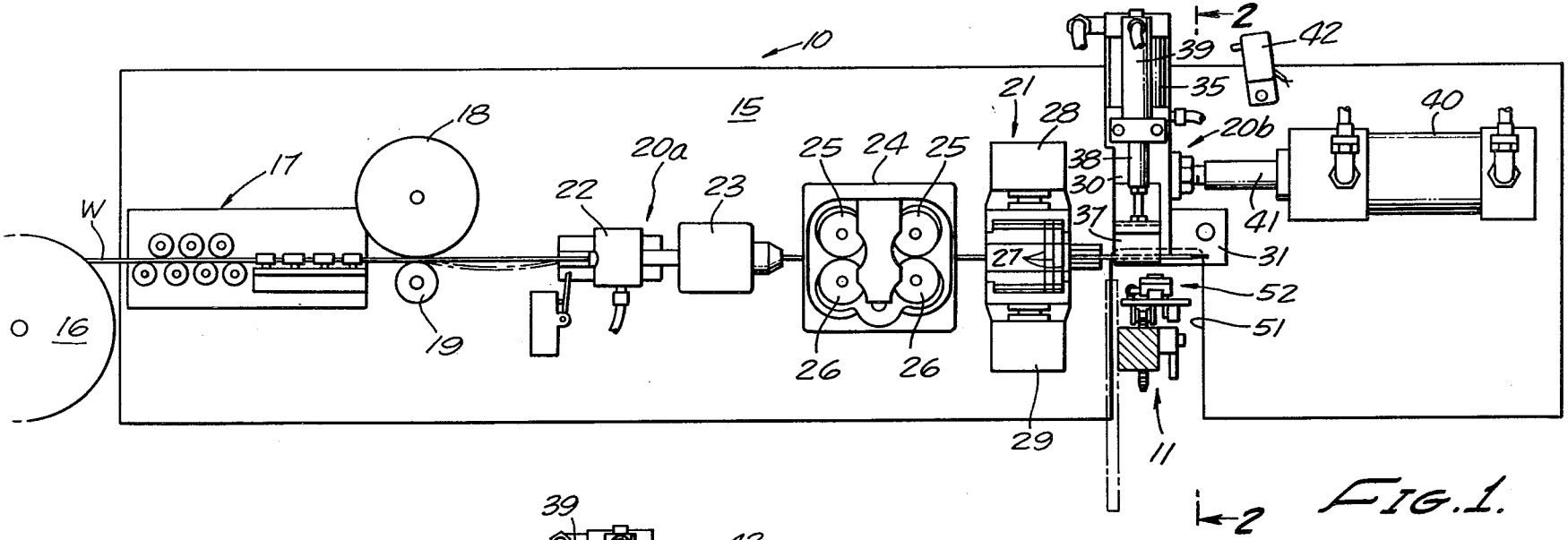
FIG. 1 is a front elevational view of a wire cutter and insulation stripping apparatus as embodied in the present invention and which supplies the conductor lengths which are to have the terminal attached to at least one end thereof.

As best shown in FIG. 1, the cutter and stripping apparatus 10 may vary as to details of construction, but basically comprises conventionally known apparatus which is illustrated as embodying a main panel 15 upon which the various components are mounted. A wire W is fed from the left end of the panel 15 from a supply reel 16 or other suitable source into a wire straightening device 17 of conventional construction, and thence to a length measuring mechanism which includes a measuring wheel 18 that is operatively associated with a presser wheel 19, the measuring wheel being associated with a cycling control for determining the sequence of operation of the cutter and stripping mechanisms.

The measured wire is conducted to a first stripping mechanism **20*a* which is positioned on the feed side of a wire cutting mechanism 21 and includes pneumatically operable means 22 for the controlled gripping of the wire W during a stripping operation in response to movement by means of a pneumatically energizable cylinder-piston actuator 23** in a manner well known in the art.

The wire W then passes through a feeding mechanism 24 between a set of upper rollers 25 and lower rollers 26, these rollers being arranged for actuation into feeding engagement with the wire, and to a slightly separated position in which the feeding of the wire will be terminated.

From the feeding mechanism, the wire is conducted to the cutting mechanism 21, wherein a series of blades 27, are operable in a well known manner by means of upper and lower cylinder-piston actuators 28 and 29 to completely sever the wire and cut through portions of the insulation only on opposite sides of the wire cutting blade.

A second stripping mechanism **20*b* is positioned on the discharge side of the cutting mechanism and is synchronously controlled and operated in cooperative relationship to the first stripping mechanism 20*a*** to remove the severed insulation portions by pulling the severed wire ends in opposite directions away from the cutting blade.

Figure 6:
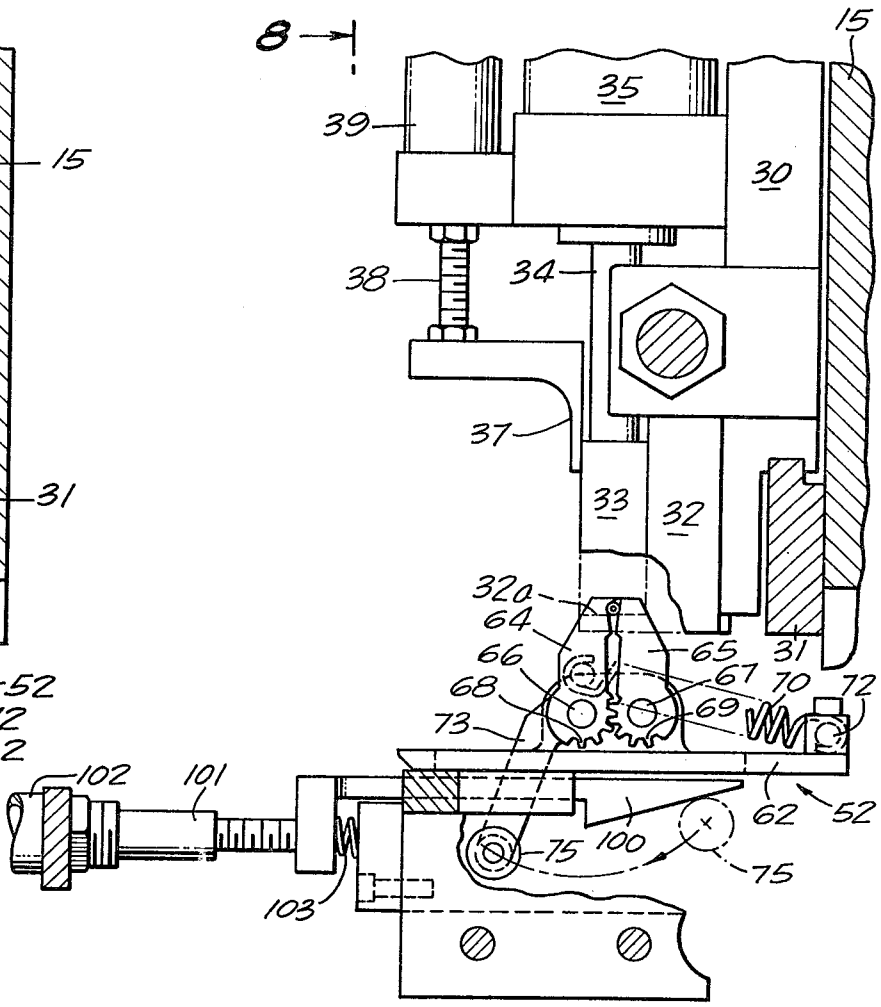
FIG. 6 is a similar view to that of FIG. 5, but showing the gripping fingers in gripped relation with the clamp supported wire conductor.
Figure 5:
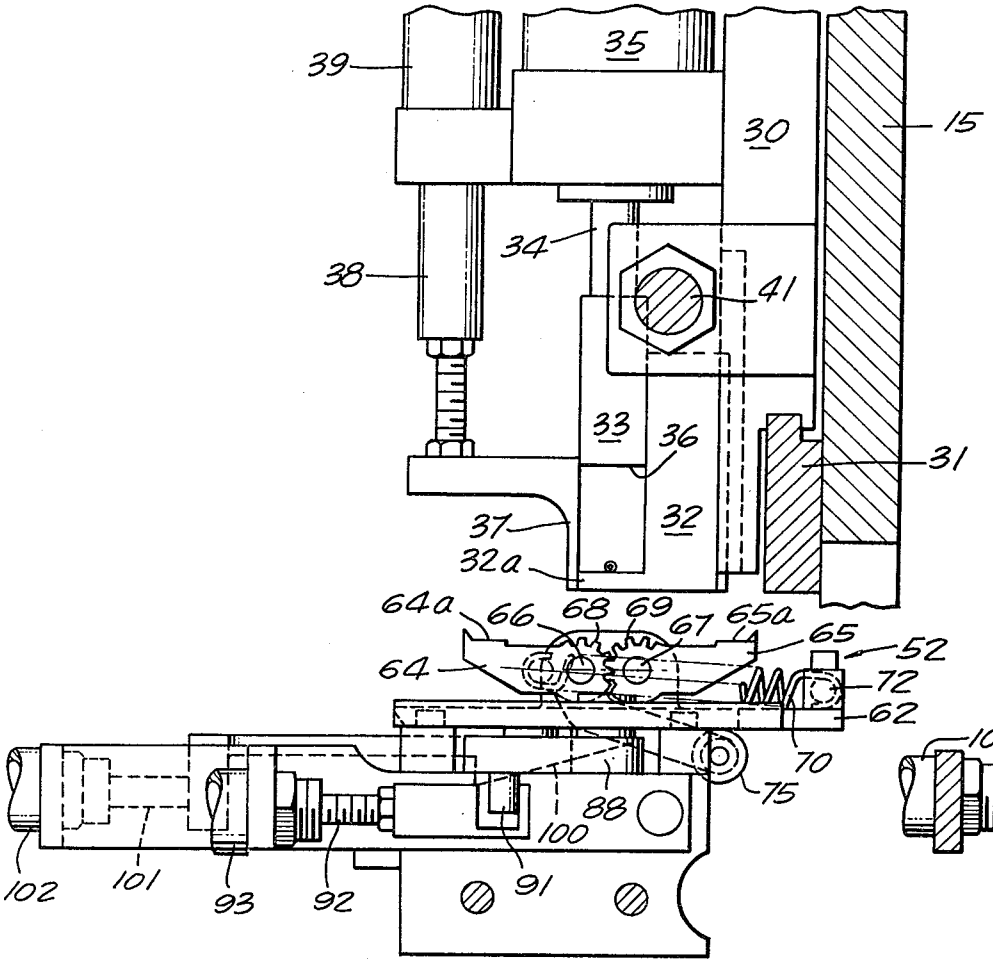
FIG. 5 is an enlarged fragmentary transverse sectional view taken through the stripping mechanism in the pick-up zone showing the wire clamping members in open position and a finger gripping assembly with its fingers in opened position below the wire conductor.

As shown, the second stripping mechanism **20*b* is mounted upon a back panel 30 which is supported for rectininear lateral sliding movement upon a support rail 31, as best shown in FIGS. 5 and 6. The back panel 30 mounts a pair of wire engaging jaw or clamping members 32 and 33. The clamping member 32 is adjustably affixed to the back panel 30, and the clamping member 33 is connected with the piston rod 34 of an actuating cylinder 35 for reciprocable movements between an opened position of the clamping members and a closed position in which the clamping member 33 coacts with an extension 32*a* of the clamping member 32** to grippingly engage the wire.

Figure 7:
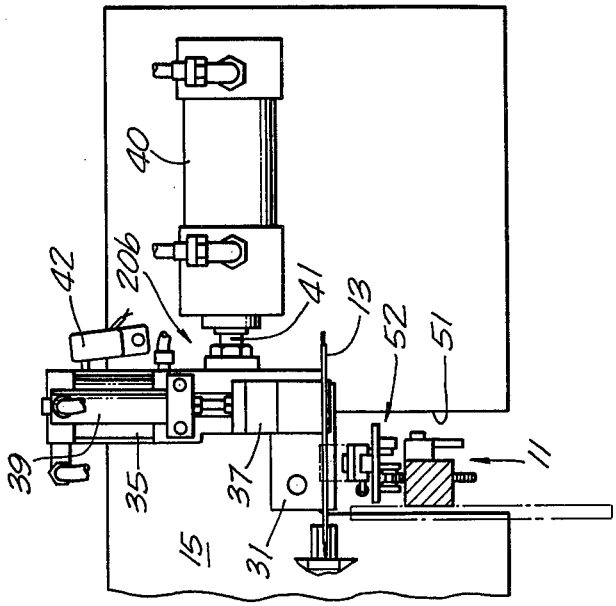
FIG. 7 is a fragmentary front elevation of the stripping mechanism in the pick-up zone, with the mechanism laterally shifted from the position shown in FIG. 1.

The second stripping mechanism **20*b* is initially positioned in close proximity to the wire cutting mechanism, as shown in FIG. 1, to receive the measured length of wire which is to be cut and stripped, the clamping members 32 and 33 being in opened position at this time and coacting to form an open sided groove 36 for guidingly receiving the wire by an axial feeding movement thereof. A gate member 37 normally closes the open side of the groove, this gate being operatively connected with a piston 38 of a control cylinder 39 by means of which the gate may be initially closed during the reception of the wire, and later opened after the second stripping mechanism 20*b* has been shifted rectilinearly to a conductor pick-up position, as shown in FIG. 7. Shifting of the second stripping mechanism 20*b* to the pick-up position is accomplished by means of an actuator cylinder 40 which is mounted on the main panel 15 and has a piston rod 41 connected with the back panel 30**.

With each operation of the wire cutter and stripping apparatus, the movement of the stripping mechanism **20*b* to its stripping position, as shown in FIGS. 7 and 8, will provide a conductor 13 with stripped ends at a pick-up position in a conductor supply zone. As the stripping mechanism 20*b* is moved into the pick-up position, it will activate switch means 42 of appropriate control means to initiate a sequence of operating functions including the activation of the conveyor mechanism 11 and associated components, as will subsequently be more fully described, to pick up and transport the delivered conductor 13** to the terminal attaching zone where a terminal is attached to an end of the conductor.

Figure 2:
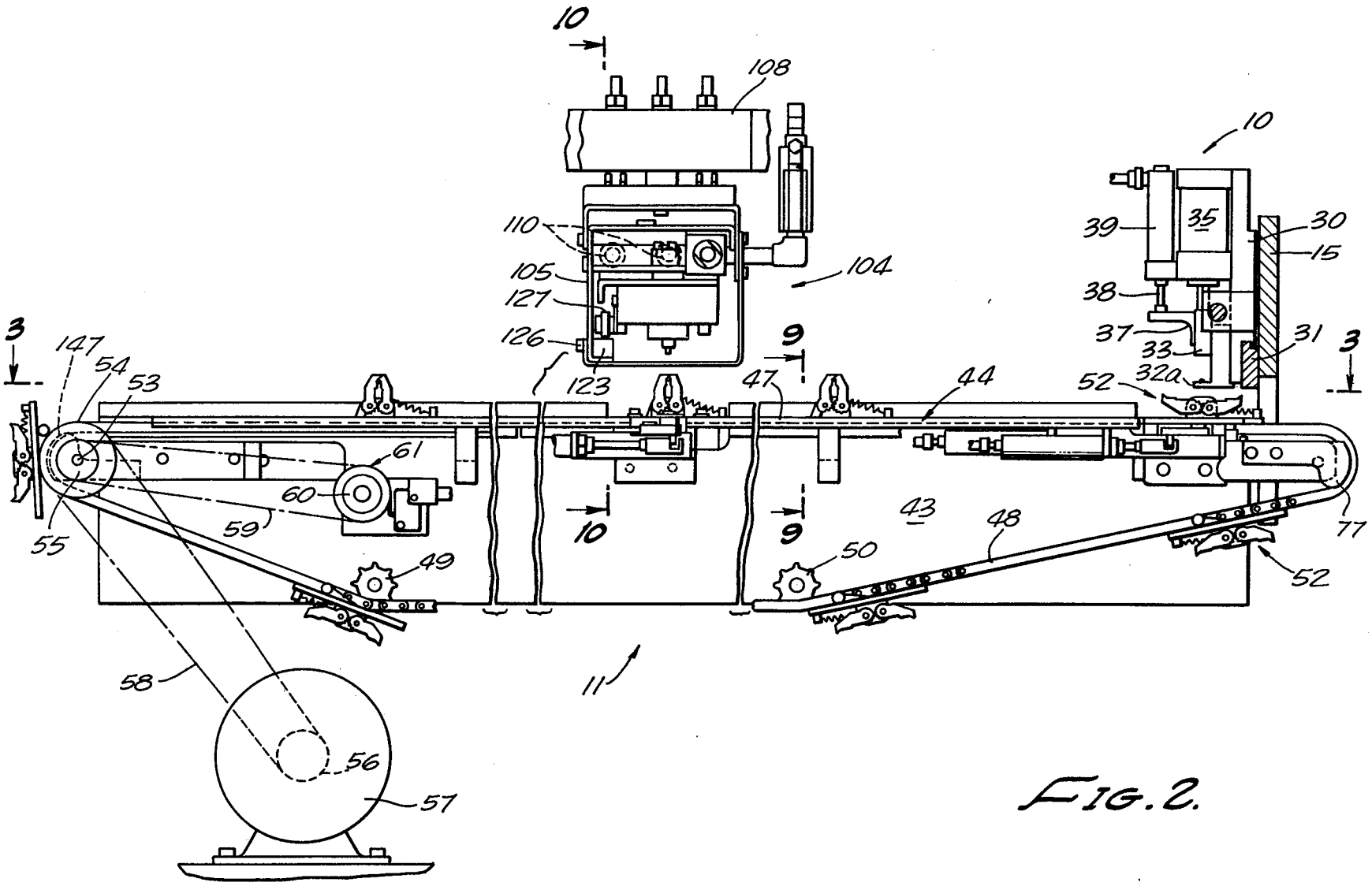
FIG. 2 is a transverse sectional view, taken substantially on line 2—2 of FIG. 1, of the stripping mechanism at the conductor supply zone, and including an associated conveyor mechanism, as shown in side elevation, for transporting the electric conductors from the conductor supply zone to the terminal attaching zone.
Figure 3:
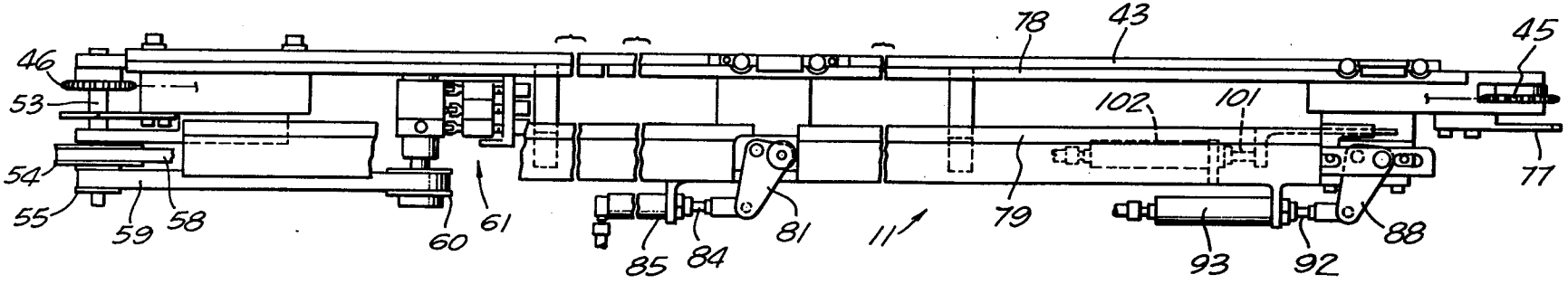
FIG. 3 is a fragmentary top plan view of the conveyor mechanism, as seen from line 3—3 of FIG. 2, the conveyor chain being removed, and other portions being cut away to show certain details of the operative components.

As best shown in FIGS. 2 and 3, the conveyor mechanism 11 is supported upon an appropriate frame structure, which includes an upstanding frame plate member 43, that extends forwardly of the main panel 15 in a generally normal direction thereto. On one side of this plate member there is provided a conveyor chain 44 which is looped around an idler sprocket 45 at the inner end of the loop, and around a driving sprocket 46 at the outer end of the loop so as to provide a generally horizontal upper run 47, and a lower run 48 which is maintained in a widened spaced relation to the upper chain run by means of idler sprockets 49 and 50. The inner end of the conveyor, as shown in FIG. 2, has its end portion extending through an opening 51 of the panel 15. As thus arranged, the conductors 13 will be picked up by conductor gripping finger assemblies, as generally indicated at 52, attached to the conveyor chain while positioned in the horizontal upper run of the chain.

At the driving end of the conveyor chain, as shown in FIGS. 2 and 3, the driving sprocket 46 is mounted on a rotatable shaft 53 which mounts at one end a pair of pulleys 54 and 55. The pulley 54 is preferably of the toothed type and is driven from a similarly toothed driving pulley 56 of a driving electric motor 57 by means of an interconnecting toothed timing belt 58. The pulley 53 is also preferably of the toothed type and is operatively connected by a timing belt 59 with a toothed driven pulley 60 of a cam actuated switch assembly, as generally indicated at 61. This switch assembly comprises a plurality of control switches which are operable in combination with other components of the control system to synchronously coordinate the operations of certain parts of the apparatus. For example, one of these switches may be utilized to stop the driving motor 57 and apply its brake in order to properly locate the finger gripping assemblies 52, respectively, at the pick-up position in the conductor zone and the terminal attaching zone. Another of these switches may be utilized to control means for locking the finger gripping assembly in the terminal attaching zone against movement. The remaining switch may be utilized to coordinate the operations of the conveyor and the return of the second stripping mechanism **20*b*** to its initial conductor receiving position.

Figure 4:
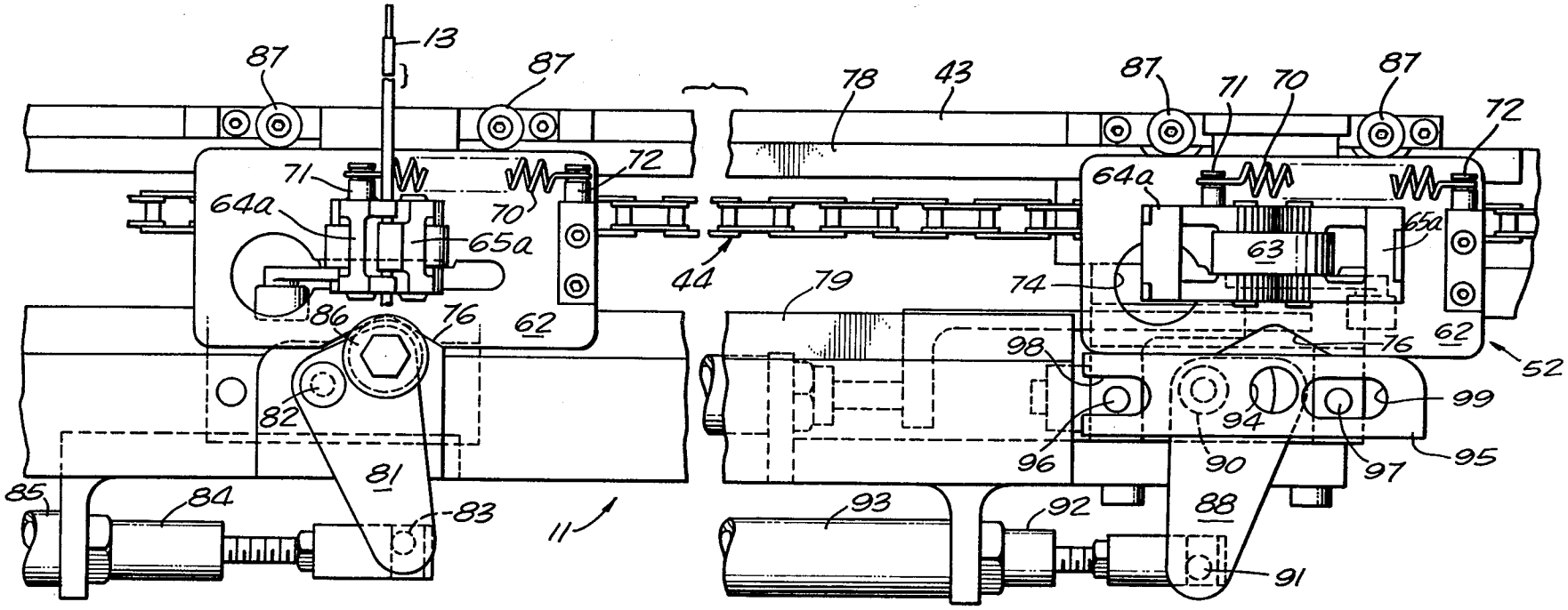
FIG. 4 is an enlarged fragmentary plan view, similar to FIG. 3, but with finger gripping assemblies positioned respectively in the conductor supply zone and the terminal attaching zone, and the means for accurately positioning the assemblies and locking the conveyor against movement during the conductor pick-up and terminal attaching operations.

The construction of the finger gripping assemblies is best shown by reference to FIGS. 4, 5 and 6. As will be seen, the assembly is mounted upon a carrier plate 62 of generally rectangular configuration and is conformed to provide a central mounting block 63 for a pair of conductor gripping finger members 64 and 65. These fingers are of generally U-shaped construction and have their innermost ends in straddling relation to the block 63 and adjacently pivotally mounted on transversely extending pivots 66 and 67. The outer ends of the fingers are formed with conductor gripping jaw faces **64*a* and 65*a*, respectively. The pivoted ends of the fingers are provided with intermeshing sector gear portions 68 and 69 which coact to tie the fingers together for unitary movement between a non-gripping opened position extending along the carrier plate in substantially opposed 180° relation, and in a closed gripping position in substantially 90° relation to the carrier plate. In moving between the opened and closed positions, the fingers are arranged to pass through an over-center position with respect to a tension spring 70 which is shown as having one end connected with a projecting stud 71 on the finger members 64, and its other end anchored to a stud 72 secured to the carrier plate 62. As thus arranged, the fingers will be resiliently urged towards their opened and closed positions. Opening and closing of these fingers is accomplished by means of an actuating arm 73 which is integrally formed with the finger member 64 and extends through an opening 74 to the opposite side of the carrier plate 62, and at its outer end mounts a roller 75. This roller, as shown in FIG. 5, is adapted to engage against the adjacent face of the carrier plate 62, when the finger members are in opened position. As best seen in FIG. 4, the carrier plate 62 is provided at its longitudinal center with a V-shaped edge notch 76**, for a purpose which will hereinafter be explained.

As shown in FIG. 2, the finger gripping assemblies 52 are in spaced relation on the conveyor chain such that a finger assembly will be concurrently positioned in the conductor supply zone and in the terminal attaching zone. The finger assemblies in the lower run 48 of the conveyor will ordinarily be in their opened position, due to its having discharged a conductor with the fixed terminal at the discharge end of the conveyor. However, if a finger assembly should for some reason be in a closed position, the actuating arm 73 will then occupy a position as shown in full lines in FIG. 6, wherein the roller 75 will be substantially spaced from the carrier plate 62. In this case, a camming member 77 at the inner end of the conveyor loop will engage the roller 75 and move the closed gripping fingers towards an open position through dead center, whereupon the spring 70 will function to urge the fingers into an open position for movement into the conductor pick-up position at the supply zone.

At the proper position of the finger assemblies in the supply zone and terminal attaching zone, appropriate controls will disconnect the motor 57 and apply its brake to stop the chain movement. A unique feature of the present invention resides in the provision of means for locking the conveyor chain in the stopped position and for clampingly laterally securing the finger assemblies in their proper positions, respectively, in the supply zone and terminal attaching zone with respect to a pair of laterally spaced rails 78 and 79 upon which the carrier plates of the finger assemblies are slidably supported during movement in the upper run of the chain conveyor, the chain 44 being connected with each of the carrier plates 62 by means of lugs 80, as shown in FIG. 8.

As shown in FIG. 4, the locking operation is accomplished by means of a rocker arm 81 which is swingably mounted upon a fixed pivot 82. A rocker arm has an actuating pivotal connection 83 with a reciprocable piston rod 84 that is operatively associated with a power cylinder 85. The rocker arm also carries a roller 86 which is adapted to seat in the edge notch 76 and longitudinally accurately center the finger assembly 52 in relation to the terminal attaching mechanism. The actuation of the rocker arm also functions to laterally move the carrier plate 62 into clamped engagement against a pair of spaced positioning rollers 87 which are appropriately supported in the top portion of the plate frame member 43.

Simultaneously with the locking operation of the finger assembly 52 in the terminal attaching zone, a somewhat similar arrangement is provided for clamping the finger assembly 52 that is in the supply zone against the positioning rollers 87 at this location. For this purpose, a rocker arm 88 is supported for pivotal movement on a fixed pivot 90. This rocker arm has one pivotal connection 91 with a reciprocating piston 92 of a power cylinder 93. The rocker arm also has a pivotal connection 94 with a presser bar 95 which is mounted for limited longitudinal and transverse movements by means of a pair of spaced pins 96 and 97 respectively positioned in slots 98 and 99. As thus arranged, it will be apparent that energization of the power cylinder 93 will operate to swing the rocker arm 88 about its pivot and force the pressure bar 95 against the adjacent edge of the carrier plate 62 in a manner to cause it to clampingly engage against the positioning rollers 87 and thus positively hold this finger assembly in a proper position for picking up the conductor in the supply zone.

As previously explained, the finger members 64 and 65 of the finger assembly 52 as thus clampingly positioned, will be in an opened position as shown in FIG. 5. Closure of the finger members 64 and 65 is accomplished by means of a reciprocably mounted tapered linear cam member 100 which is supported for reciprocal movement in a path between the roller 75 on the actuating arm 73 of the finger assembly and the adjacent face of the carrier plate 62 as shown in FIG. 5. The cam 100 is operatively connected with a piston rod 101 of a power cylinder 102. When the power cylinder is energized, the cam 100 will be moved between the roller 75, as shown in phantom lines, and the carrier plate 62, and by this action the roller 75 will be moved past a dead center position of the finger members 64 and 65, whereupon the spring 70 will urge the fingers into a wire clamping position, as shown in full lines in FIg. 6. A compression spring 103 is provided to return the cam member to an inactive position, when the power cylinder 102 is deenergized.

Figures 10, 16:
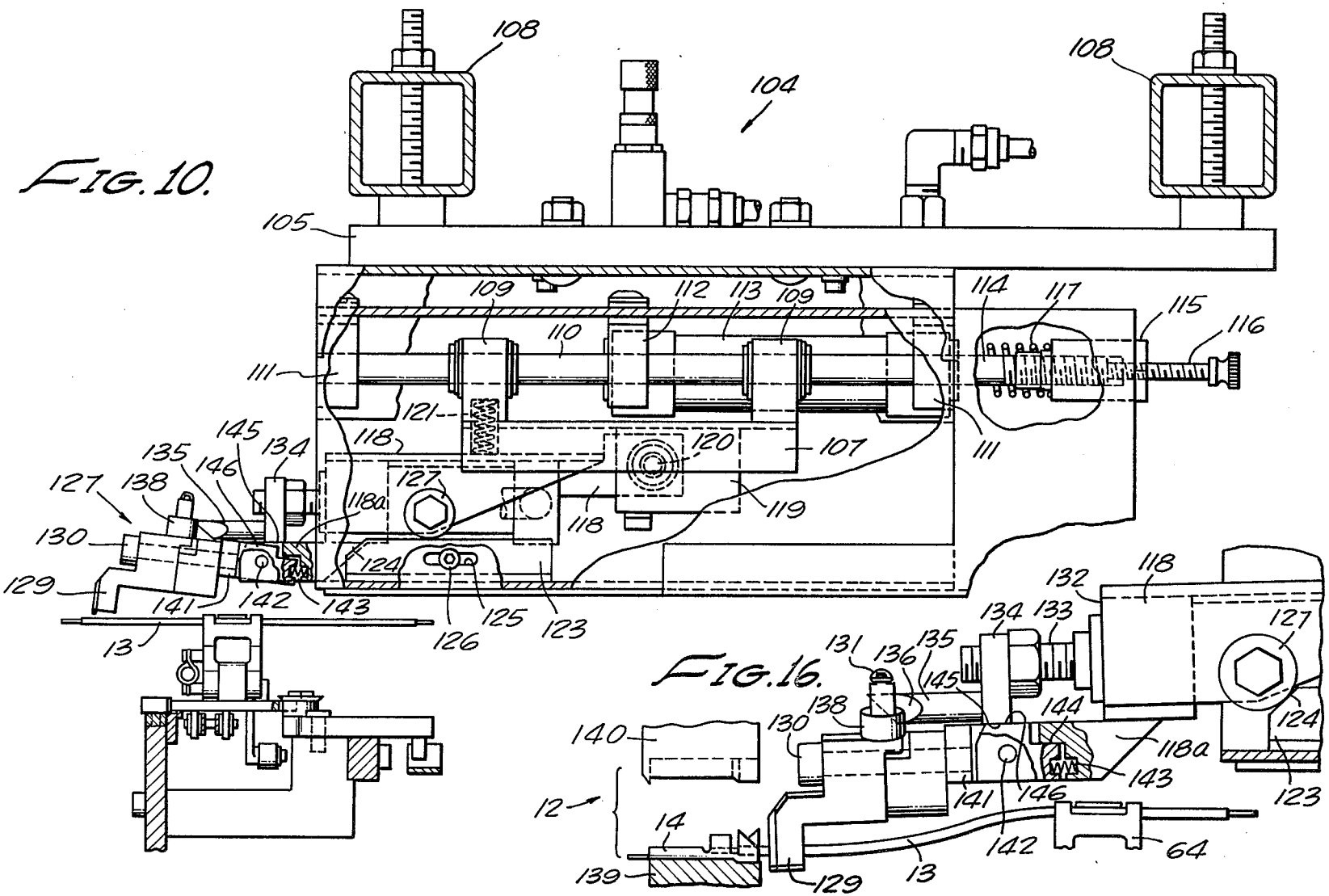
FIG. 10 is an enlarged fragmentary transverse sectional view taken substantially on line 10—10 of FIG. 2, and showing details of construction of the wire insertion device.
FIG. 16 is a view similar to that of FIG. 11, except that the wire gripping fingers have been shifted to the left and downwardly to displace the conductor end out of the conductor axis and into the side opening of the terminal barrel.

At the terminal attaching zone, the end of the conductor 13 to which the terminal is to be applied is positioned in the receiving barrel portion of the terminal by means of a wire insertion device, as generally indicated at 104 in FIG. 2 as being supported from an appropriate frame structure in a position above the finger gripping assembly 52 that clampingly supports the conductor 13 therein. As best shown in FIG. 10, the wire insertion device comprises a housing structure 105 of generally rectangular configuration, which is supported in an operative position from an overhead frame structure 108, and within which there is mounted a main chassis carriage 107. This carriage is supported at each of its opposite ends by a pair of laterally spaced bearings 109 having sliding relation with a pair of guide rods 110 permitting reciprocable movements of the main chassis carriage. The guide rods 110 are rigidly supported within the upper portion of the housing 105 by means of end supports 111 and a central support 112. Reciprocable movements of the chassis carriage 107 is accomplished by a power actuator cylinder 113 having a double ended piston rod 114, one end of the piston rod being connected with the left end of the chassis carriage, as viewed in FIG. 10, and the other end of the piston rod being threadedly engaged with one end of an internally threaded coupling 115. The other end of this coupling is internally threaded to receive an axially extending locking screw 116. A cushioning spring 117 is positioned in the space between the coupling 115 and the adjacent end of the power actuator cylinder 113. The coupling 115 permits an adjustment with respect to the connected end of the piston rod to vary the point at which the compression spring 117 becomes effective, and the adjusted position of the coupling 115 may be locked simply by turning the locking screw 116 until its inner end engages the adjacent end of the piston rod. The arrangement just described also permits manual manipulation of the main chassis frame to move it towards the right end of the housing, when desired.

A sub-carriage 118 is positioned below the main carriage and has one end supported within a pivot block 119 of the main carriage, by means of a pivot 120 which is arranged to enable swinging movement of the sub-carriage in a clockwise direction under the urging force of a compression spring 121. This swinging movement is normally opposed during initial reciprocable movement of the main carriage towards the left, by means of a roller 122 which is normally in rolling engagement with the upper surface of a cam bar 123 which is provided at one end with an inclined surface 124. Upon continued movement of the sub-carriage, the roller 122 will ride over the inclined surface 124 and thereby enable pivotal movement of the sub-carriage under the action of the spring 121 so as to swing the left end of the sub-carriage from a horizontal axis of movement downwardly to an inclined angularly extending position as shown in FIG. 16. The point at which the swinging movement of the sub-carriage occurs is adjustable by varying the longitudinal position of the cam bar 123. This is accomplished by means of an elongate slot 125 in an adjacent wall of the housing, and a set screw 126 which extends through the slot and has threaded engagement with the cam bar.

Figure 13:
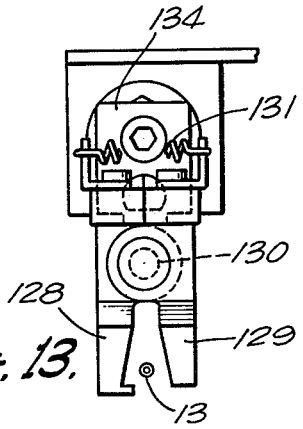
FIG. 13 is an end elevational view of the same, as seen from line 13—13 of FIG. 11.
Figure 14:
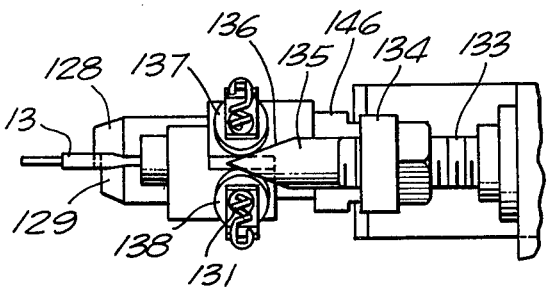
FIG. 14 is a view similar to FIG. 12, with the fingers in wire gripping position.
Figure 15:
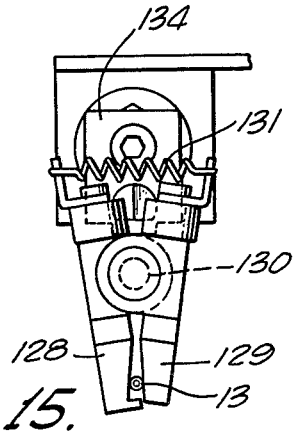
FIG. 15 is an end elevational view similar to FIG. 13, except that the fingers are in a wire gripping position.

The sub-carriage 118 supports a conductor gripping finger assembly, as generally indicated at 127, which is normally positioned over the conductor at the terminal attaching zone and has a pair of wire gripping fingers 128 and 129 that are swingably supported upon a pivot 130 for movement into gripping and non-gripping relation to the conductor 13. As shown in FIGS. 13 and 15, the fingers 128 and 129 are in a generally vertical position and are interconnected at their uppermost ends by a tension spring 131 which normally acts to spread the wire gripping ends of the fingers into a separated non-gripping position. Movement of the fingers 128, 129 into gripping relation on the conductor 13 is accomplished by means of a power cylinder 132 which has its piston rod 133 connected to a supporting bracket 134 for a wedge pin 135 having a tapered end portion 136 that is adapted to extend between a pair of rollers 137 and 138 respectively mounted on the upper ends of the fingers 128 and 129, and upon actuation force the open fingers into gripped relation with the conductor 13 which is at this time being held by the finger gripping assembly 52 at the terminal attaching zone.

After the fingers 128 and 129 are in gripped relation with the conductor 13, the power cylinder 113 will be energized by the actuation of suitable controls to shift the main carriage 107, sub-carriage 118 and the finger assembly 127 as a unit to axially move the gripped conductor 13 endwise of the gripping finger members 64 and 65 of the finger gripping assembly 52 so as to position the stripped end of the conductor in a proper relationship to the wire receiving portion of a terminal 14 positioned on an anvil 139 of the terminal attaching mechanism 12, this anvil being operatively associated with a crimping die 140. If the terminal has a closed sleeve wire receiving portion, the travel of the roller 122 on the cam bar 123 will be limited to the linear edge portion of the cam bar 123 so that the endwise movement of the conductor 13 will be substantially horizontal and the end of the conductor will be inserted endwise directly into the closed sleeve of the terminal. In the event that the terminal has an open sleeve, the cam bar 123 will be adjusted so that the roller 122 will initially move the gripped conductor horizontally to a position in which its end is disposed above the open barrel of the terminal, and upon further movement will pass over the inclined surface 124 and let the subcarriage pivotally move to deflect the end of the conductor laterally into the receiving barrel of the terminal, as shown in FIG. 16. When the stripped end of the conductor is positioned in the receiving portion of the terminal, appropriate controls will operate to cause the movement of the die 140 to crimp the terminal to the conductor end in a manner well known in the prior art.

Figure 11:
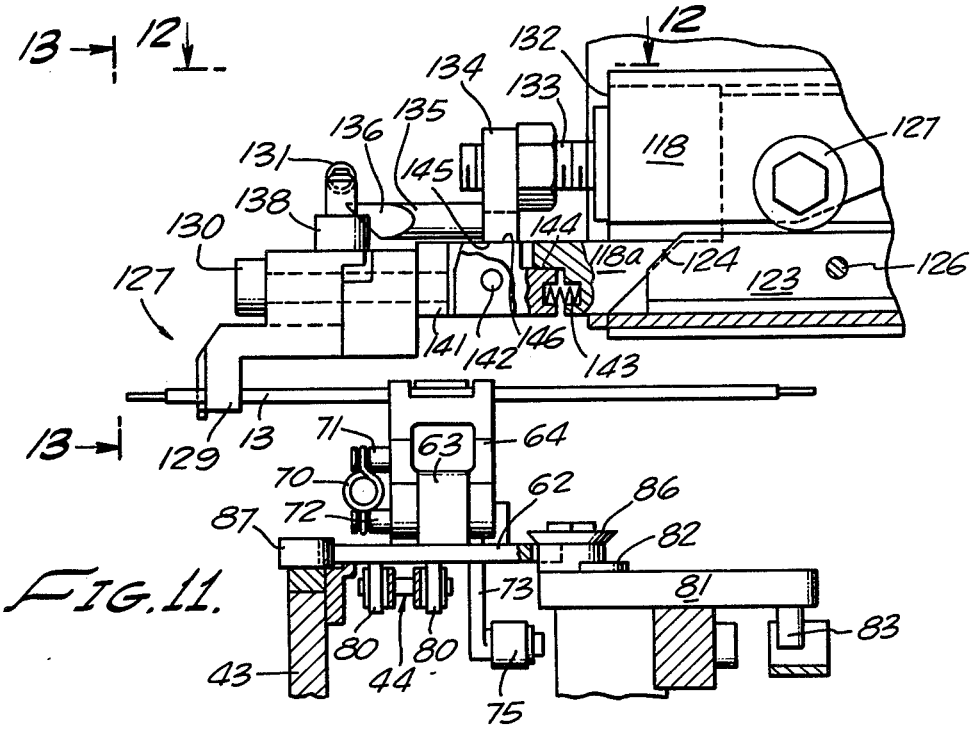
FIG. 11 is an enlarged fragmentary elevational view of the left end of the wire insertion device, as shown in FIG. 10, and with the wire gripping fingers engaged with the conductor in the terminal attaching zone.
Figure 12:
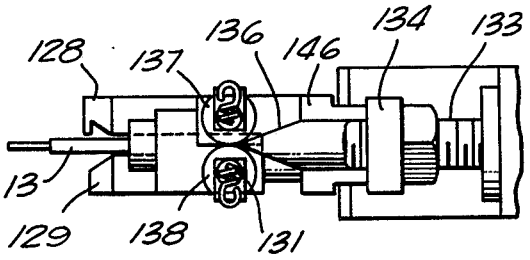
FIG. 12 is a fragmentary top plan view, as seen from line 12—12 of FIG. 11, showing the means for closing the wire engaging fingers.

As thus far described, the construction and operation of the wire insertion device 104 is conventional, and has been previously known in the prior art. As a feature of the present invention, the conductor gripping finger assembly 127 is arranged for independent pivotal movement with respect to the associated sub-carriage 118 in order to initially elevate the wire gripping fingers 128 and 129 and provide greater clearance for the passage of the conductor 13 as it is being moved into the terminal attaching zone. For this purpose, the conductor gripping finger assembly 127 is mounted upon an arm extension 141 which is pivotally connected to an adjacent portion 118*a* of the sub-carriage 118 by a suitable pivot 142. A compression spring 143 normally acts to urge the arm 141 towards a raised position of the conductor gripping finger assembly 127. In the non-raised or horizontal position, the pivotal movement of the arm 141 in a counterclockwise direction is limited by the engagement of abutment shoulders at 144 of the arm and the sub-carriage portion 118*a*, as best shown in FIG. 11. In moving the arm 141 from the raised position as shown in FIG. 10, to the horizontal position as shown in FIG. 11, it will be seen that this movement is accomplished by the outward movement of the supporting bracket 134, the lower edge 145 of which is in sliding engagement with the upper edge 146 of the arm 141.

Once the terminal has been affixed to the end of the conductor 13 at the terminal attaching zone, the timing control will reset the wire insertion device by retracting the piston rod 133 and energizing the cylinder 113 in a direction to move the main chassis carriage 107 to its retracted right hand position, and at the same time energize the power cylinders 85 and 93 to unlock the conveyor chain and permit its movement to bring the next conductor finger gripping assemblies 52 respectively into position at the supply zone and terminal attaching zone. When a conductor finger gripping assembly 52 with a conductor having the terminal attached to its end reaches the outer end of the conveyor mechanism, a camming member 147 will engage and actuate the arm 73 of the approaching finger gripping assembly 52 in a manner to move its fingers to an open position and release the conductor with the attached terminal for discharge into a suitable receiver.

From the foregoing description, it is believed that it will be apparent that the heretofore outlined objects of the invention will be attained, and that the apparatus embodying the described features provides inherent advantages in the production of electric conductors with affixed terminals.

Various modifications may suggest themselves to those skilled in the art without departing from the spirit of the disclosed invention and, hence, it is not wished to be restricted to the specific form shown or uses mentioned, except to the extent indicated in the appended claims.

I claim:

1. Apparatus for attaching terminals to the ends of electric conductors, comprising:

a. means for axially delivering predetermined lengths of electric conductors endwise into a conductor supply zone;

b. a terminal attaching zone spaced from said conductor supply zone, including cooperable terminal attaching die means for receiving a terminal therebetween, said terminal having an end portion for reception of an end of said conductor;

c. means for successively picking up and transporting the conductor lengths laterally from the conductor supply zone to a position in said terminal attaching zone, in which said end of the conductor is disposed in endwise spaced relation to said terminal end portion, comprising:

a movable conveyor having spaced finger assemblies for successively picking up the conductors delivered to the supply zone, each of said finger assemblies including a pair of pivotally mounted finger members interconnected for concerted movement to opened and closed relation, said finger members having coacting jaw portions moved to gripping relation in the closed position of said finger members and non-gripping relation in the opened position of said finger members;

means for moving said finger members to place the jaw portions in non-gripping relation to admit a conductor length in the supply zone therebetween, and thereafter move said finger members to place the jaw portions in gripping relation with said conductor length;

d. means in the terminal attaching zone for moving said conductor in a path to position said end in said terminal end portion; and e. means including said die means for crimping said terminal end portion on the received conductor end.

2. Apparatus according to claim 1, which includes means for positioning said finger members in the supply zone laterally and axially with respect to said conductor length prior to movement of the jaw portions into gripping relation with said conductor length.

3. Apparatus according to claim 1, which includes means at the terminal attaching zone for positioning said finger members and gripped conductor with respect to the terminal which is to be attached.

4. Apparatus according to claim 3, in which said positioning is in directions axially and laterally of said conveyor means.

5. Apparatus according to claim 1, in which the finger members are interconnected for concerted movements by meshed gear means adjacent their pivots.

6. Apparatus according to claim 1, wherein the conveyor comprises a link chain looped to form upper and lower runs extending between a driving sprocket at one end and an idler sprocket at the other end positioned in the supply zone; each of said finger assemblies is mounted upon a carrier plate attached to said chain; and track means guidingly supports said carrier plates and the mounted finger assemblies during movement in the upper run of the conveyor.

7. Apparatus according to claim 1, in which the finger members project from one side of said carrier plate, and one of said finger members has an extension actuating arm extending to the opposite side of said carrier plate; the members in opened position extending along said carrier plate in substantially opposed 180° relation and in closed position in substantially 90° relation to said carrier plate; and over-center spring means acts to move said finger members respectively towards said opened and closed positions.

8. Apparatus according to claim 7, in which the outer end of said actuating arm, in the opened position of said finger members, is closely adjacent said carrier plate; and the means for moving said finger members into gripping relation with said conductor length comprises a tapered linear cam member supported for movement between said carrier plate and an end portion of said arm to move the arm in a closing direction of said finger members and through a dead center position with respect to said spring means.

9. Apparatus according to claim 8, in which the cam member engages a roller mounted on the outer end of said arm.

10. Apparatus according to claim 6, which includes rollers on one side of said track means positioned for lateral engagement by said carrier plate in the conductor supply zone; and means on the opposite side of said track for engaging the carrier plate, and being operable to urge the carrier plate laterally against said rollers to position the finger members with respect to the conductor length prior to movement of the jaw portions into gripping relation with said conductor length.

11. Apparatus according to claim 10, wherein the carrier plate urging means comprises an elongated presser bar supported for lateral movements towards and away from said carrier plate; and a pivotally mounted rocker arm having one pivoted connection with said presser bar and another pivotal connection with an actuating power means.

12. Apparatus according to claim 6, which includes rollers on one side of said track means positioned for lateral engagement by said carrier plate in the terminal attaching zone; and means on the opposite side of said track for engaging the carrier plate, and being operable to urge the carrier plate against said rollers and lock the carrier plate and associated finger assembly against movement in an axial direction of said conveyor.

13. Apparatus according to claim 12, wherein the means on the opposite side of said track comprises a V-notch in the adjacent edge of said carrier plate; and a pivoted rocker arm mounting a roller, and having a pivotal connection with an actuating power means for rotating the rocker arm and moving the roller into a seated position in said V-notch.

14. Apparatus for attaching terminals to the ends of electric conductors, comprising:

a. means for axially delivering predetermined lengths of electric conductors endwise to receiver means supported for rectilinear movement in the supply zone between an initial conductor receiving position and a conductor pick up position, said receiver means comprising:
   a pair of clamping members movable between clamped and non-clamped positions, and in the non-clamped position coacting in said initial receiving position to form an open sided groove for guidingly receiving the conductor by an axial feeding movement thereof;
   a gate member closing the open side of said groove in said initial receiving position;
   means for moving said clamping members into clamped position with respect to the received conductor in said initial receiving position;
   means for opening and maintaining said gate in an open position with respect to said groove in the pick-up position;
b. a terminal attaching zone spaced from said conductor supply zone, including cooperable terminal attaching die means for receiving a terminal therebetween, said terminal having an end portion for reception of an end of said conductor;
c. means for successively picking up and transporting the conductor lengths laterally from the conductor supply zone to a position in said terminal attaching zone, in which said end of the conductor is disposed in endwise spaced relation to said terminal end portion;
d. means in the terminal attaching zone for moving said conductor in a path to position said end in said terminal end portion; and
e. means including said die means for crimping said terminal end portion on the received conductor end.

15. Apparatus for attaching terminals to the ends of electric conductors, comprising:

a. means for axially delivering predetermined lengths of electric conductors endwise into a conductor supply zone;
b. a terminal attaching zone spaced from said conductor supply zone, including cooperable terminal attaching die means for receiving a terminal therebetween, said terminal having an end portion for reception of an end of said conductor;
c. means for successively picking up and transporting the conductor lengths laterally from the conductor supply zone to a position in said terminal attaching zone, in which said end of the conductor is disposed in endwise spaced relation to said terminal end portion;
d. means in the terminal attaching zone for moving said conductor in a path to position said end in said terminal end portion, comprising:
   a pair of jaw members for grippingly engaging said end portion of a transported conductor;
   means for initially bodily shifting the gripped jaws a predetermined distance in an axial direction of said conductor to place said end above an open barrel portion of the terminal, and thereafter pivot said jaws in a direction to laterally move said end into the barrel portion; and
e. means including said die means for crimping said terminal end portion on the received conductor end.

16. Apparatus for attaching terminals to the ends of electric conductors, comprising:

a. means for axially delivering predetermined lengths of electric conductors endwise into a conductor supply zone;
b. a terminal attaching zone spaced from said conductor supply zone, including cooperable terminal attaching die means for receiving a terminal therebetween, said terminal having an end portion for reception of an end of said conductor;
c. means for successively picking up and transporting the conductor lengths laterally from the conductor supply zone to a position in said terminal attaching zone, in which said end of the conductor is disposed in endwise spaced relation to said terminal end portion;
d. means in the terminal attaching zone for moving said conductor in a path to position said end in said terminal end portion; comprising:
   a main carriage structure supported for rectilinear movements in generally horizontal opposite directions;
   a sub-carriage pivoted at one end of said main carriage;
   means normally restraining said sub-carriage to movements in a generally horizontal rectilinear path;
   a projecting arm member pivoted on said subcarriage for vertical swinging movement, said arm being normally urged towards an outwardly and upwardly inclined position;

a pair of downwardly extending conductor gripping fingers carried by the outer end of said arm, said fingers being normally urged towards an open non-gripping position;

actuating means operative to first pivot said arm to a generally horizontal position to position the associated end of said conductor between the open fingers and thereafter close the fingers into clamped engagement with said conductor;

means for moving said main carriage to axially move the gripped conductor endwise to a predetermined position of its end with respect to the receiving portion of the terminal; and e. means including said die means for crimping said terminal end portion on the received conductor end.

17. Apparatus according to claim 16, wherein the means for restraining the movement of the sub-carriage to a rectilinear path is operative at said predetermined position to release the sub-carriage for a downward swinging movement and effect lateral shifting of the conductor end from said predetermined position.

* * * * *